United States Patent [19]

Lintunen

[11] Patent Number: 4,544,448

[45] Date of Patent: Oct. 1, 1985

[54] FILTER PRESS

[75] Inventor: Tuomo Lintunen, Savonlinna, Finland

[73] Assignee: Enso-Gutzeit Osakeyhtiö, Helsinki, Finland

[21] Appl. No.: 554,836

[22] Filed: Nov. 23, 1983

[30] Foreign Application Priority Data

Nov. 25, 1982 [FI] Finland ..... 824052

[51] Int. Cl.[4] ..... D21F 3/06; D21F 3/02

[52] U.S. Cl. ..... 162/360.1; 100/118; 100/154; 162/301; 162/305; 210/400; 210/401

[58] Field of Search ..... 162/358, 360.1, 300, 162/301, 303, 305, 273, 274; 210/400, 401; 100/118, 119, 120, 153–154, 161

[56] References Cited

U.S. PATENT DOCUMENTS

| | | | |
|---|---|---|---|
| 1,925,972 | 7/1932 | Standley et al. | 162/360.1 |
| 2,448,295 | 8/1948 | Bratton | 162/360.1 |
| 2,959,222 | 11/1960 | Hornbostel | 162/360.1 |
| 3,600,273 | 8/1971 | McCarrick et al. | 162/273 |
| 3,796,149 | 3/1974 | Heissenberger | 162/358 |

*Primary Examiner*—S. Leon Bashore
*Assistant Examiner*—K. M. Hastings
*Attorney, Agent, or Firm*—Toren, McGeady, Stanger, Goldberg & Kiel

[57] ABSTRACT

A filter press having a main press with an after-pressing device spaced from the outlet end of the main press which device carries out the final pressing and is composed of at least two press roll pairs (1,2), made up of rolls (3,4,5,6) between which the wires (7,8) belonging to the main press pass with the pulp (9) being filter pressed interposed between the wires and pressed by action of a pressing force (F) directed against the topside rollers (3,5) of the press roll pairs and produced by a force applicator such as a pressure cylinder (10). The pressure ratio ($F_1/F_2$) between the topside rollers (3,4) and the bottom side rollers (5,6) is adjustable by the aid of a control setup.

3 Claims, 4 Drawing Figures

FILTER PRESS

The present invention concerns a filter press having at its ultimate or outlet end from its main press an after-pressing means carrying out the final pressing and consisting of at least two press roll pairs between which the wires belonging to the main press pass and the pulp interposed between the wires is pressed by action of a pressing force directed for instance on the topside rollers and produced by a force means such as e.g. a pressure cylinder.

In filter presses of this type known in the art, in the after-pressing means of which a plurality of press roll pairs, or nips, are employed in order to increase the ultimate dry matter content, it has only been possible to divide the pressing force in a given fixed proportion between the nips, this proportion being determined by the permanent structures. The object of the invention is to develop further said filter press. The filter press of the invention is characterized in that the pressure ratio of the press rolls is adjustable by the aid of a control means. It is thus understood that by the aid of the invention the pressing forces of the press roll pairs can be adjusted in relation to each other even in connection with trial runs or start-up runs. The ratio of these pressing forces could not be adjusted in prior art at all: their ratio was always constant.

An advantageous embodiment of the invention, wherein the press roll pairs have been joined in a common frame, is characterized in that the control means consists of a plurality of mounting points for the cylinder ends, by the aid of which the position of the cylinder is adjustable longitudinally to the pulp web. The position of the cylinder may therefore be coarse-adjusted prior to starting up the filter press.

Another embodiment of the invention, wherein the press roll pairs have been joined in a common frame, is characterized in that the control means consists of mounting points for the cylinder ends which are steplessly or continuously adjustable in the longitudinal direction of the pulp web, such as of pivots displaceable by adjustment screws. The position of the cylinder may therefore be finely adjusted even while the filter press is operating.

A third embodiment of the invention, wherein the press roll pairs have been joined in a common frame, is characterized in that the control means consists of slides movable longitudinally to the pulp web and on which the cylinder ends have been mounted. This is an alternative or combined embodiment with reference to the preceding embodiments.

The invention is described in the following by the aid of an example, reference being made to the drawing attached, wherein FIG. 1 presents the filter press in elevational view.

Figure 1:
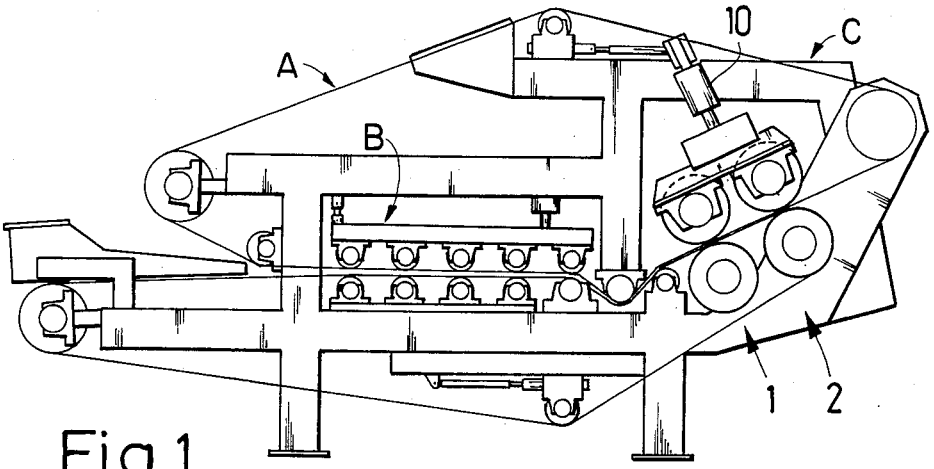
Figure 2:
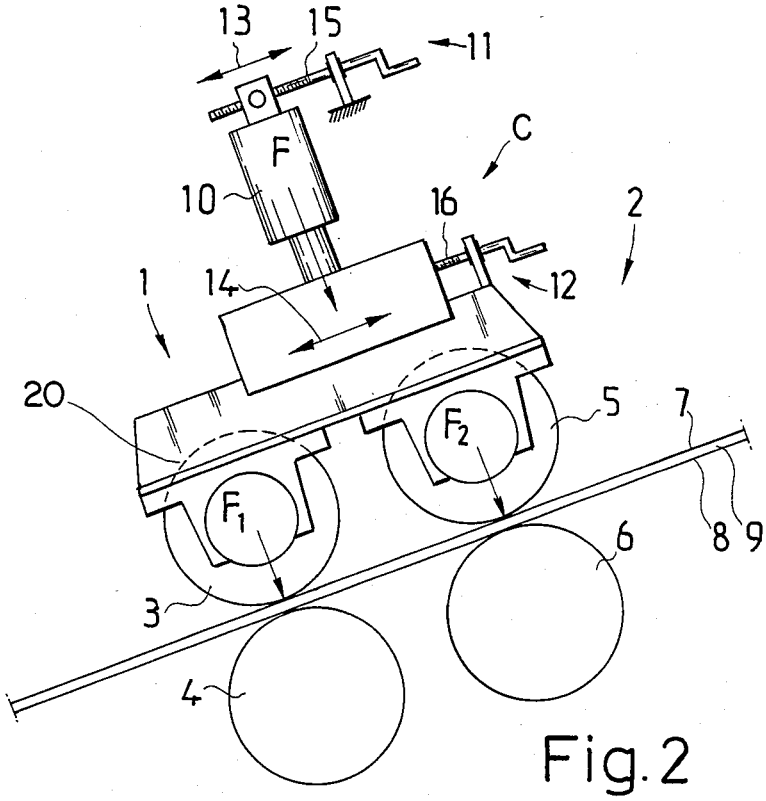
FIG. 2 shows, enlarged, the after-pressing means at the ultimate end of the filter press.

In FIG. 1 a filter press A is shown containing a main press B with upper and lower rollers. A upper wire 7 and a lower wire 8 convey pulp through the main press B from an inlet end on the left to an outlet end on the right. An after-pressing means C is spaced from the outlet end of the main press B in the long direction defined by the direction extending between the inlet and outlet ends.

The after-pressing means C at the ultimate or outlet end of the main press B performs the final pressing for increasing the dry matter content. The after-pressing means C consists of two pairs of press rolls 1,2, formed by topside rollers 3,5 and bottom side rollers 4,6 with the wires 7,8 belonging to the press running between the rollers 3,4 and 5,6 the pulp web 9 interposed between the wires being pressed by action of the pressing force F directed on the topside rollers 3,5 and produced by the pressure cylinder 10. The topside rollers 3,5 are supported on a support member 20. The pressure ratio $F_1/F_2$ of the rolls 3,4 and 5,6 is adjustable by the aid of the control means 11,12 in the directions indicated by arrows 13,14. The control means 11,12 consists of adjusting screws 15,16 steplessly or continuously movable in the long direction of the pulp web 9. Thus the ratio of the pressing forces $F_1$ and $F_2$ between the press roll pairs 3,4 and 5,6 can be adjusted even in connection with trial runs or start-up runs. The pressing forces are distributed through the support member 20 to the topside rollers 3,5. In all filter presses heretofore known, said ratio of the pressing forces has always been constant.

It is obvious to a person skilled in the art that the invention is not confined to the example presented in the foregoing but may vary within the scope of the claims stated below. For instance, the ratio between the pressing forces may be adjusted by means of two pressure-exerting cylinders, of which the hydraulic pressure is controllable by techniques known in themselves.

Figure 3:
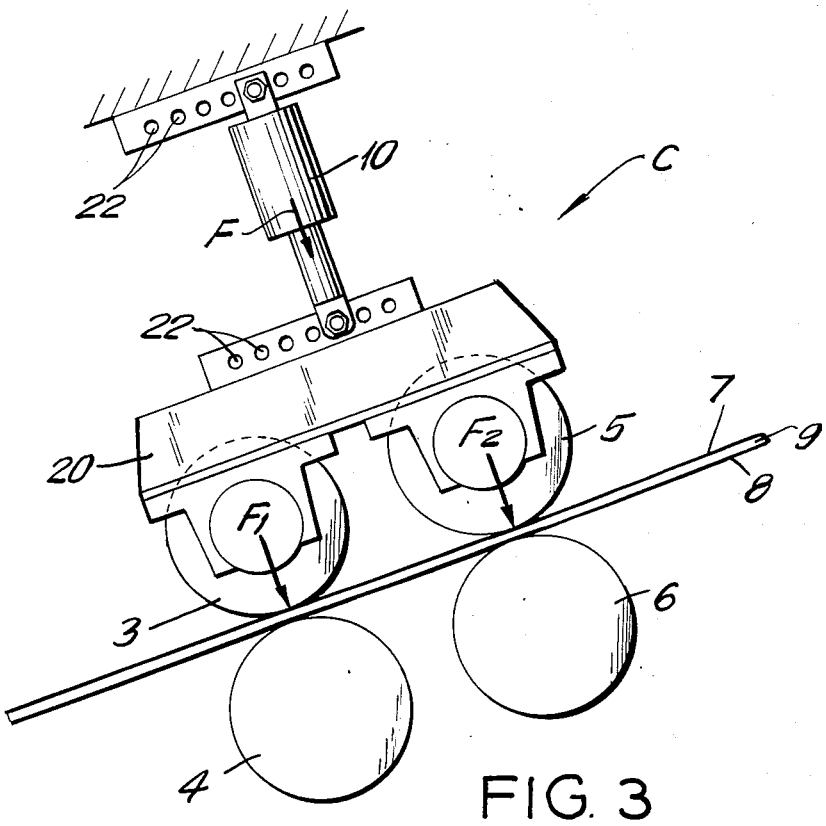
FIG. 3 is a view similar to FIG. 2 illustrating the multiple mounting points of the control means.

In FIG. 3 a plurality of mounting points 22 are shown for the pressure cylinder 10 so that the position of the cylinder in the long direction of the pulp web 9 and relative to the support member 20 can be adjusted.

Figure 4:
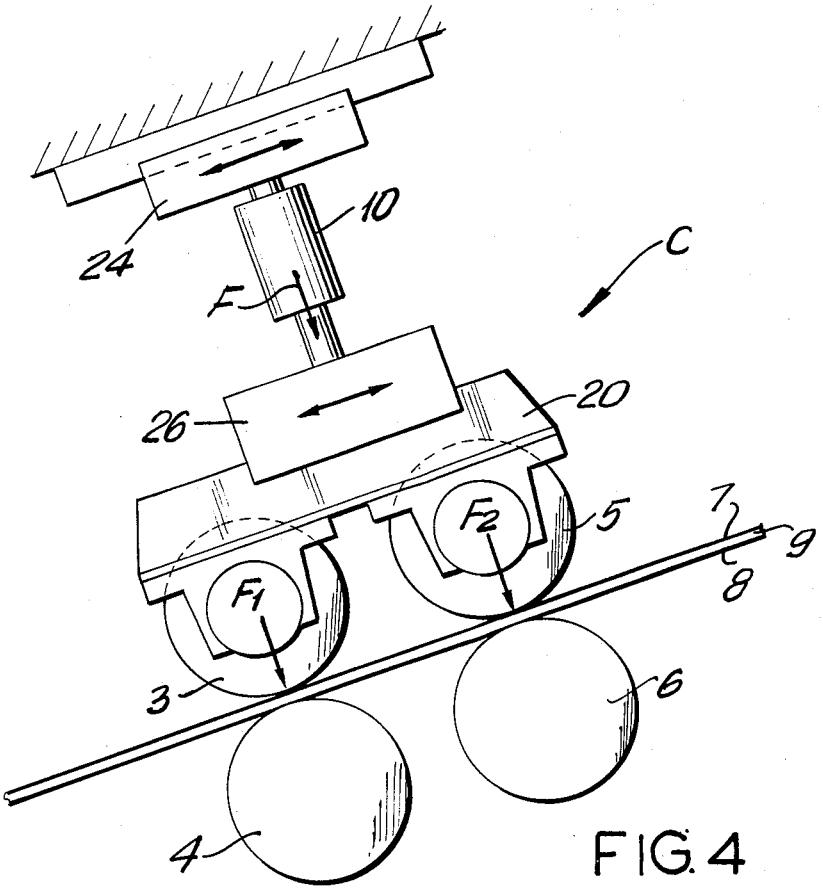
FIG. 4 is a view similar to FIG. 3 illustrating the slides for the control means.

In FIG. 4 an upper slide 24 and a lower slide 26 is provided at the opposite ends of the cylinder 10 so that the position of the cylinder can be adjusted relative to the support member 20 in the long direction of the pulp web 9.

I claim:

1. Filter press having a main press with an inlet end and an outlet end and a long direction extending in the direction between the inlet end and the outlet end, said main press having upper and lower rollers extending transversely of the long direction and spaced apart in the long direction, an upper wire and a lower wire located between said upper and lower rolls and extending in the long direction of said main press and outwardly from the outlet end thereof and conveying a pulp web to be pressed through said main press, said upper and lower wires continuing in the long direction outwardly from the outlet end of said main press, after-pressing means spaced above and below said upper and lower wires and located outwardly from the outlet end of said main press for effecting a final pressing of the pulp web located between said upper and lower wires after the pulp web exits from the outlet end of said main press, said after-pressing means comprising a first pair of press rolls and a second pair of press rolls spaced apart in the long direction and each said pair of press rolls comprising a topside roller located above said upper and lower wires and a bottom side roller located below said upper and lower wires, a single common support member supporting said topside rollers of each said pair of press rolls in fixed positions relative to one another and to said support member, a pressure cylinder for applying pressure to said support member for pressing said topside rollers toward said bottom side rollers and exerting a force (F) against said support member so that the force (F) is distributed to said topside rollers whereby said topside rollers of said first pair of press rolls exerts a force ($F_1$) and said topside roller of said second pair of press rolls exerts a force ($F_2$), a single control means acting on said support member and on said pressure cylinder for applying pressure for adjusting the pressure ratio $F_1/F_2$ exerted by said topside rollers, said pressure cylinder has an upper end and a lower end, said control means comprising a first support bracket for the upper end of said cylinder containing a plurality of mounting points, a second support bracket for the lower end of said pressure cylinder fixed to said support member and having a plurality of mounting points corresponding to said mounting points in said first bracket, said mounting points spaced apart in the long direction, whereby the position of said cylinder can be adjusted in the long direction relative to said support member and said pulp web.

2. Filter press having a main press with an inlet end and an outlet end and a long direction extending in the direction between the inlet end and the outlet end, said main press having upper and lower rollers extending transversely of the long direction and spaced apart in the long direction, an upper wire and a lower wire located between said upper and lower rolls and extending in the long direction of said main press and outwardly from the outlet end thereof for conveying a pulp web to be pressed through said main press, said upper and lower wires continuing in the long direction outwardly from the outlet end of said main press, after-pressing means spaced above and below said upper and lower wires and located outwardly from the outlet end of said main press for effecting a final pressing of the pulp web located between said upper and lower wires after the pulp web exits from the outlet end of said main press, said after-pressing means comprising a first pair of press rolls and a second pair of press rolls spaced apart in the long direction and each said pair of press rolls comprising a topside roller located above said upper and lower wires and a bottom side roller located below said upper and lower wires, a single common support member supporting said topside rollers of each said pair of press rolls in fixed positions relative to one another and to said support member, a pressure cylinder for applying pressure to said support member for pressing said topside rollers toward said bottom side rollers and exerting a force (F) against said support member so that the force (F) is distributed to said topside rollers whereby said topside rollers of said first pair of press rolls exerts a force ($F_1$) and said topside roller of said second pair of press rolls exerts a force ($F_2$), a single control means acting on said support member and on said pressure cylinder for applying pressure for adjusting the pressure ratio $F_1/F_2$ exerted by said topside rollers, said pressure cylinder has an upper end and a lower end, said control means comprises a first adjustable member connected to the upper end of said pressure cylinder, a second adjustable member connected to the lower end of said pressure cylinder so that said pressure cylinder can be continuously displaced in the long direction relative to said support member and to said pulp web.

3. Filter press having a main press with an inlet end and an outlet end and a long direction extending in the direction between the inlet end and the outlet end, said main press having upper and lower rollers extending transversely of the long direction and spaced apart in the long direction, an upper wire and a lower wire located between said upper and lower rolls and extending in the long direction of said main press and outwardly from the the outlet end thereof for conveying a pulp web to be pressed through said main press, said upper and lower wires continuing in the long direction outwardly from the outlet end of said main press, after-pressing means spaced above and below said upper and lower wires and located outwardly from the outlet end of said main press for effecting a final pressing of the pulp web located between said upper and lower wires after the pulp web exits from the outlet end of said main press, said after-pressing means comprising a first pair of press rolls and a second pair of press rolls spaced apart in the long direction and each said pair of press rolls comprising a topside roller located above said upper and lower wires and a bottom side roller located below said upper and lower wires, a single common support member supporting said topside rollers of each said pair of press rolls in fixed positions relative to one another and to said support member, a pressure cylinder for applying pressure to said support member for pressing said topside rollers toward said bottom side rollers and exerting a force (F) against said support member so that the force (F) is distributed to said topside rollers whereby said topside rollers of said first pair of press rolls exerts force ($F_1$) and said topside roller of said second pair of press rolls exerts a force ($F_2$), a single control means acting on said support member and on said pressure cylinder for applying pressure for adjusting the pressure ratio $F_1/F_2$ exerted by said topside rollers, said pressure cylinder comprises an upper end and a lower end, said control means comprises a first slide connected to the upper end of said pressure cylinder and a second slide connected to the lower end of said pressure cylinder and said slides being displaceable in the long direction relative to said support member for adjusting the pressure ratio $F_1/F_2$.

* * * * *